US008586884B2

(12) United States Patent
Voli et al.

(10) Patent No.: US 8,586,884 B2
(45) Date of Patent: Nov. 19, 2013

(54) TAMPER-RESISTANT KEYPAD FOR MOBILE DEVICE

(75) Inventors: Edward M. Voli, East Setauket, NY (US); Frank Gong, Syosset, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 207 days.

(21) Appl. No.: 13/165,863

(22) Filed: Jun. 22, 2011

(65) Prior Publication Data

US 2012/0325635 A1 Dec. 27, 2012

(51) Int. Cl.
*H01H 9/26* (2006.01)

(52) U.S. Cl.
USPC ..... 200/5 A

(58) Field of Classification Search
USPC ..... 200/5 A, 1 B
See application file for complete search history.

(56) References Cited

U.S. PATENT DOCUMENTS

| | | | | | |
|---|---|---|---|---|---|
| 4,366,355 | A * | 12/1982 | Oelsch | 200/517 |
| 4,529,848 | A * | 7/1985 | Cherry | 200/5 A |
| 4,710,597 | A * | 12/1987 | Loheac | 200/5 A |
| 5,340,955 | A * | 8/1994 | Calvillo et al. | 200/302.2 |
| 5,912,443 | A * | 6/1999 | Hasunuma | 200/5 A |
| 2006/0042921 | A1 * | 3/2006 | Saitoh | 200/302.2 |
| 2011/0056818 | A1 * | 3/2011 | Maruyama et al. | 200/5 A |

* cited by examiner

*Primary Examiner* — Vanessa Girardi
(74) *Attorney, Agent, or Firm* — Randi L. Karpinia; Michael J. Giannetta

(57) ABSTRACT

A tamper-resistant keypad is described. The keypad includes a keycap for actuation by a user. An actuator includes a first end that is coupled to the keycap. A frame having an aperture is adapted to receive the actuator such that the second end of the actuator is captured by the frame. The actuator is prevented from being removed from the frame.

20 Claims, 3 Drawing Sheets

TAMPER-RESISTANT KEYPAD FOR MOBILE DEVICE

TECHNICAL FIELD

The invention relates generally to a tamper-resistant keypad for a mobile device.

BACKGROUND

Keypads for mobile devices are generally small due to the size of the devices. Many devices use membrane keypads, which include keys silkscreened on a rubber overlay. Some devices include keypads with multiple independent keys. These keypads can use a frame or bezel surrounding each key to provide structural support for each key. Other keypads are bezel-less in that no frame or bezel provides structural support for each key. Bezel-less keypads can be advantageous because each key can be made larger than a corresponding key in a framed keypad. However, bezel-less keypads can be susceptible to damage because a user can insert a small object such as a paperclip between the keys and dislodge them.

SUMMARY

In one aspect, the invention is embodied in a keypad. The keypad includes a keycap for actuation by a user. An actuator having a first end is mechanically coupled to the keycap. A frame having an aperture is adapted to receive the actuator. A second end of the actuator is captured by the frame such that the second end cannot be forced through the opening in the frame. This prevents the actuator from being removed from the frame.

In one embodiment, a gasket is positioned between the keycap and the frame. In one embodiment, the first end of the actuator is formed on the keycap. The second end of the actuator can include a flange. In one embodiment, the flange is mechanically attached to the second end of the actuator. Alternatively, the flange can be formed on the second end of the actuator. A cross-sectional shape of the actuator can be one of substantially circular, rectangular, square, oval, and cross-shaped.

In one embodiment, a printed circuit board is positioned adjacent to the frame such that the second end of the actuator is capable of activating a switch on the printed circuit board upon actuation of the keycap by the user. The printed circuit board can include a contact dome. The second end of the actuator is capable of compressing the contact dome upon actuation of the keycap by the user.

In another aspect, the invention is embodied in a keypad having a plurality of keycaps. Each of the plurality of keycaps is configured for activation by a user. The keypad includes a plurality of actuators. Each actuator includes a first end and a second end. The first end of each actuator is mechanically coupled to a corresponding keycap of the plurality of keycaps. A frame includes a plurality of apertures. Each aperture is adapted to receive one of the plurality of actuators such that the second end of each actuator is captured by the frame. This prevents each actuator from being removed from the frame.

In one embodiment, the keypad also includes a gasket positioned between the plurality of keycaps and the frame. The second end of each of the plurality of actuators can include a flange. In one embodiment, the flange is mechanically attached to the second end of each actuator. Alternatively, the flange can be formed on the second end of each actuator.

The keypad can also include a printed circuit board positioned adjacent to the frame such that the second end of each actuator is capable of activating a switch on the printed circuit board upon actuation of each corresponding keycap by the user. The printed circuit board can include a plurality of contact domes. The second end of each actuator is capable of compressing each contact dome upon actuation of each corresponding keycap by the user.

In another aspect, the invention is embodied in a method of manufacturing a keypad. The method includes inserting an actuator having a first end and a second end into an aperture of a frame such that the second end of the actuator is captured by the frame. This prevents the actuator from being removed from the frame. A keycap is attached to the first end of the actuator. The frame is then positioned adjacent to a printed circuit board such that the second end of the actuator is capable of contacting a contact dome on the printed circuit board upon actuation of the keycap by a user.

In one embodiment, the method includes positioning a gasket between the keycap and the frame. The method can include forming a flange on the second end of the actuator. Alternatively, the flange can be attached to the second end of the actuator.

BRIEF DESCRIPTION OF THE FIGURES

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. In addition, the description and drawings do not necessarily require the order illustrated. It will be further appreciated that certain actions and/or steps may be described or depicted in a particular order of occurrence while those skilled in the art will understand that such specificity with respect to sequence is not actually required. Apparatus and method components have been represented where appropriate by conventional symbols in the drawings, showing only those specific details that are pertinent to understanding the various embodiments so as not to obscure the disclosure with details that will be readily apparent to those of ordinary skill in the art having the benefit of the description herein. Thus, it will be appreciated that for simplicity and clarity of illustration, common and well-understood elements that are useful or necessary in a commercially feasible embodiment may not be depicted in order to facilitate a less obstructed view of these various embodiments.

The above and further advantages of this invention may be better understood by referring to the following description in conjunction with the accompanying drawings, in which like numerals indicate like structural elements and features in various figures. Skilled artisans will appreciate that reference designators shown herein in parenthesis indicate components shown in a figure other than the one in discussion. For example, talking about a device (10) while discussing Figure A would refer to an element, 10, shown in figure other than Figure A.

DETAILED DESCRIPTION

The following detailed description is merely illustrative in nature and is not intended to limit the invention or the application and uses of the invention. Furthermore, there is no intention to be bound by any express or implied theory presented in the preceding technical field, background, brief summary or the following detailed description. For the purposes of conciseness, many conventional techniques and principles related to conventional keypads, need not, and are not, described in detail herein.

For example, one conventional approach for fabricating a keypad is to employ a printed circuit board having contact domes that provide tactile feedback when a user actuates a key of the keypad. Skilled artisans will appreciate that fabricating printed circuit boards having contact domes for keypads is well known in the art and will not be discussed in detail herein.

Techniques and technologies may be described herein in terms of functional and/or logical block components and various processing steps. It should be appreciated that such block components may be realized by any number of hardware, software, and/or firmware components configured to perform the specified functions.

The following description may refer to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. The term "exemplary" is used in the sense of "example, instance, or illustration" rather than "model," or "deserving imitation."

Technologies and concepts discussed herein relate to tamper-resistant bezel-less keypads. The keypad can be a qwerty-type keypad, a number-type keypad, or any other keypad. The keypad can be any suitable shape. In an exemplary embodiment, a keypad according to the invention includes a keycap for actuation by a user. An actuator includes a first end and a second end. The first end of the actuator is physically coupled to the keycap. A frame is adapted to receive the actuator such that the second end of the actuator can include a flange that is captured by the frame. The captured actuator and corresponding attached keycap is prevented from being removed from the frame. The exemplary embodiments describe a keypad that can be used on a mobile device, such as a mobile computer, notebook, smart phone, personal digital assistant, feature phone, or any other mobile device that employs a keypad.

Figure 1:
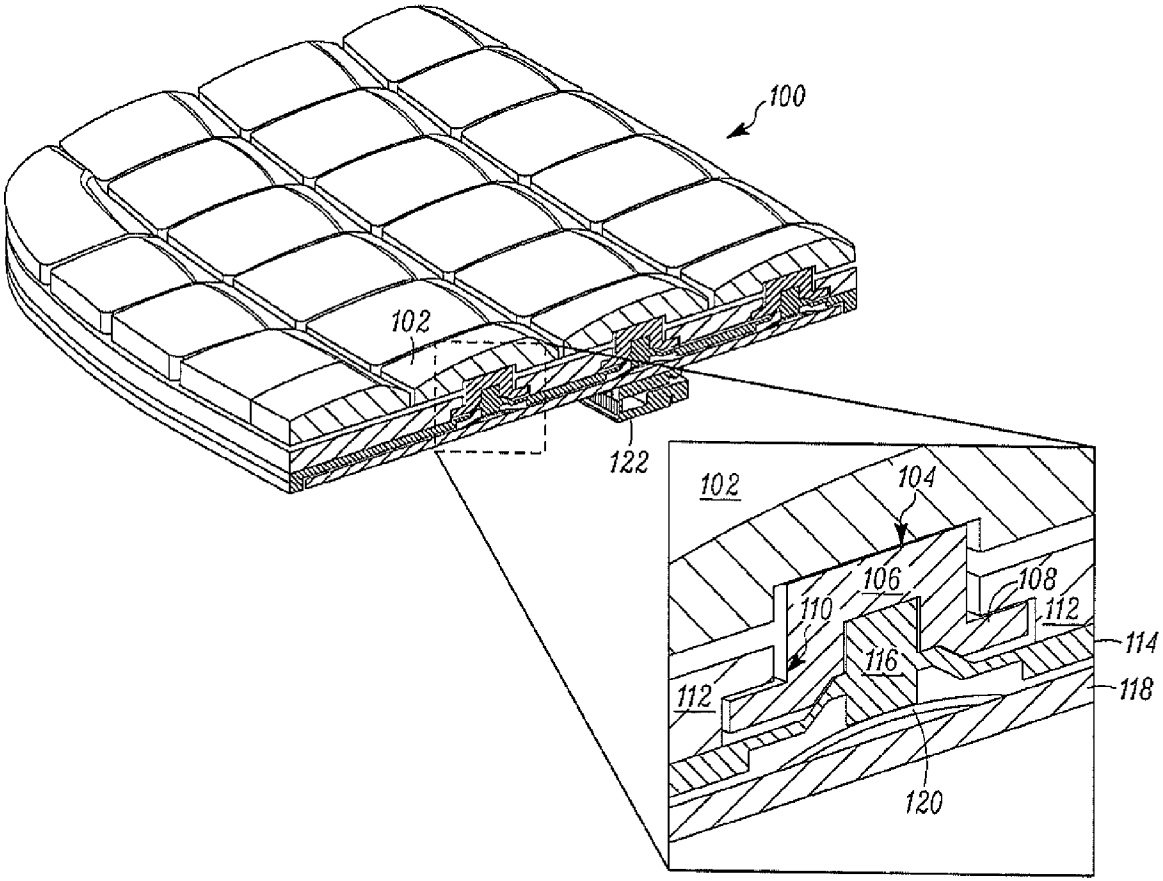
FIG. 1 illustrates a perspective view of a keypad according to an exemplary embodiment.

FIG. 1 illustrates a perspective view of a keypad 100 according to an exemplary embodiment. The keypad 100 includes a plurality of keycaps 102. The keycaps 102 can be fabricated from plastic, metal, ceramic, or any other suitable material.

A first end 104 of an actuator 106 is coupled to each keycap 102. In one embodiment, the first end 104 of the actuator 106 is glued to the keycap 102. Alternatively, the first end 104 of the actuator 106 can be attached to the keycap 102 with a fastener, such as a screw. In one embodiment, the actuator 106 is integrally formed with the keycap 102, such that the actuator 106 and the keycap 102 embody a single part.

The actuator 104 can include a flange 108. The flange 108 is coupled to a second end 110 of the actuator 106. In one embodiment, the flange 108 is glued to the second end 110 of the actuator 106. The flange 108 can also be attached to the second end 110 of the actuator 106 using a fastener, such as a screw. In one embodiment, the flange 108 is integrally formed with the actuator 106, such that the flange 108 and the actuator 106 embody a single part. In one embodiment, the second end 110 of the actuator 106 includes a plurality of flanges (not shown).

A frame 112 is positioned between the underside of the keycap 102 and the flange 108. The frame 112 includes an aperture for receiving the actuator 106. The aperture is adapted to capture the actuator 106. By capture, we mean the aperture is sized so as to prevent the flange 108 from passing through it. Thus, in one embodiment, a surface of the flange 108 contacts the frame 112 thereby preventing the actuator 106 from being removed from the frame 112.

In one embodiment, an optional flexible membrane 114 can be positioned adjacent to the frame 112. The flexible membrane 114 can be fabricated from any suitable material, such as rubber. The flexible membrane 114 can include a flexible post 116. The flexible post 116 is positioned adjacent to the actuator 106. The flexible post 116 is adapted to provide a comfortable tactile feedback response to a user when the user depresses the keycap 102. In one embodiment, the flexible membrane 114 is in the form of a web. In practice, the web can include any suitable shape or pattern.

A printed circuit (PC) board 118 is positioned adjacent to the frame 112. The printed circuit (PC) board 118 can include a contact dome 120 that is aligned relative to the actuator 106. The contact dome 120 is a momentary switch that closes when depressed. The printed circuit board 118 also includes a connector 122. The connector 122 electrically couples the keypad 100 to a processor (not shown) in a mobile device.

In operation, a user depresses a keycap 102, thereby moving the actuator 106 relative to the frame 112. The actuator 106 in turn compresses the flexible post 116. The flexible post 116 depresses the contact dome 120, thereby closing the switch. The closed state of the switch is reported via the connector 122 to the processor. The keycaps 102 are prevented from being pried off due to the flange 108 of the actuator 106 being captured by the frame 112. Thus, the keypad 100 includes tamper-resistant keys.

Figure 2:
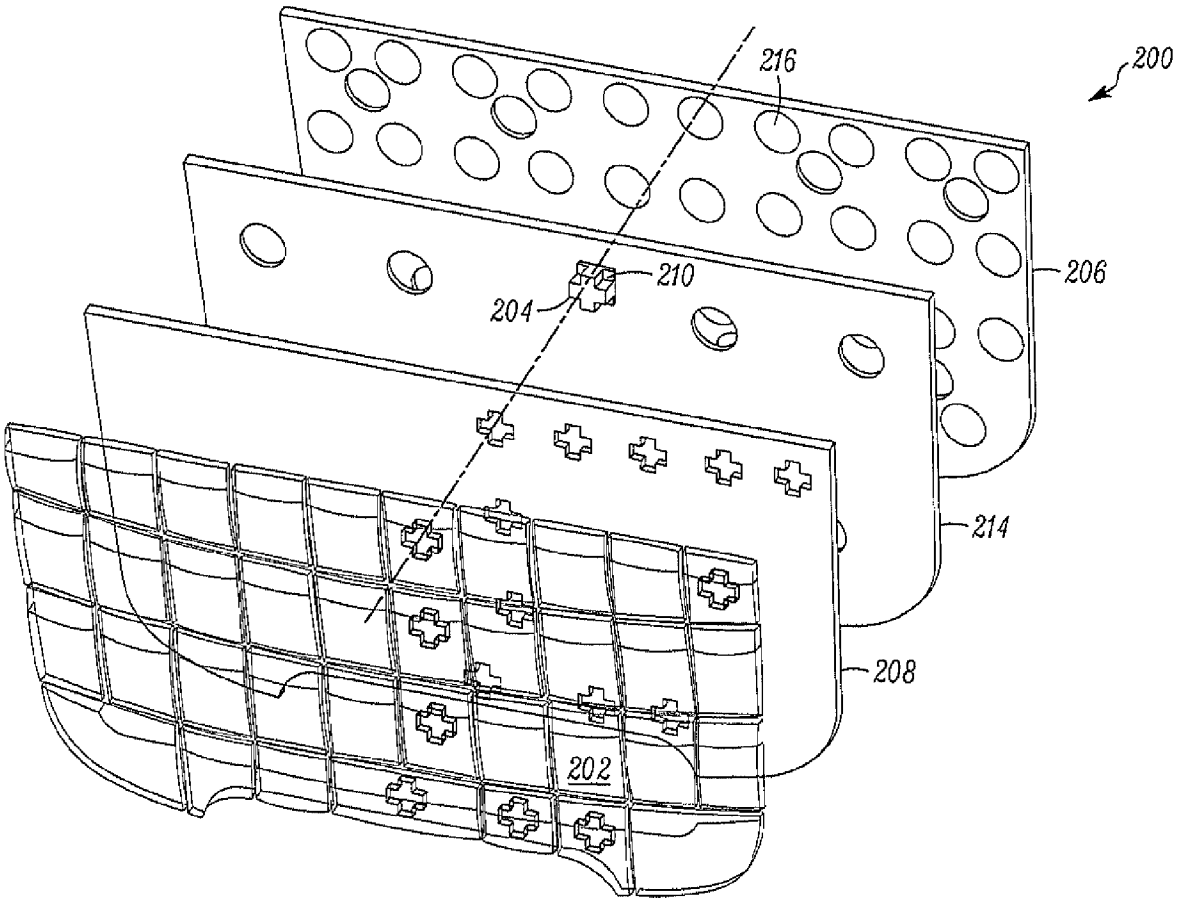
FIG. 2 illustrates an exploded view of a keypad according to an exemplary embodiment.

FIG. 2 illustrates an exploded view of a keypad 200 according to an exemplary embodiment. The keypad 200 includes a plurality of keycaps 202. The keycaps 202 are illustrated in phantom for clarity. The keycaps 202 can be fabricated from any material including plastic, metal, rubber, or any other suitable material. The keycaps 202 can be any suitable size and shape. In one embodiment, each of the keycaps 202 can include a letter, number or symbol printed thereon. In another embodiment, each of the keycaps 202 can include a letter, number, or symbol embossed thereon.

Each keycap 202 is physically coupled to an actuator 204. In alternate embodiments, the actuator 204 can be glued to the underside of the keycap 202, welded to the keycap 202, or fastened to the keycap 202 using a screw or other fastener. Alternatively, the keycap 202 and the actuator 204 can be fabricated from a single piece of material.

The actuator 204 can be any suitable shape. For example, a cross-sectional shape of the actuator 204 can be circular, rectangular, square, oval, or cross-shaped. The length of the actuator 204 can be determined based on the mechanical parameters of the keypad 200, such as the distance between each keycap 202 and a printed circuit board 206.

A frame 208 is positioned between the keycaps 202 and the printed circuit board 206. The frame 208 can be fabricated from plastic, metal, ceramic, or any suitably rigid material. The frame 208 includes a plurality of apertures 210 corresponding to the number of keycaps 202 included on the keypad 200. Each of the apertures 210 is shaped to accept an actuator 204. It should be noted that for clarity, less than all of the apertures 204 for the keypad 200 of FIG. 2 are shown.

Each actuator 204 includes a flange 212 which is sized larger than a corresponding aperture 204 in the frame 208. The flange 212 prevents the actuator 204 from passing through the frame 208 as the frame 208 captures the flange 210 of the actuator 204.

A flexible membrane 214 or sheet, such as a sheet of rubber material can be optionally positioned between the actuator 204 and the printed circuit (PC) board 206. The flexible membrane 214 provides a resilient surface for the actuator 204 to contact.

The printed circuit board 206 is positioned adjacent to the flexible membrane 214. The printed circuit board 206 includes a plurality of contact domes 216. The contact domes 216 are switches that correspond to each keycap 202.

Figure 3B:
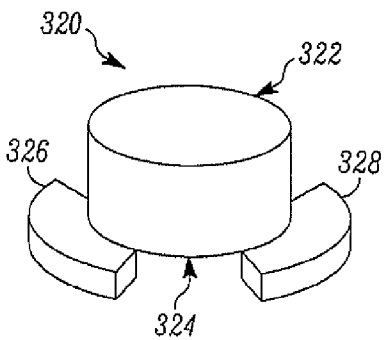
FIG. 3B illustrates an actuator formed with multiple flanges that can be used with the keypad of FIG. 1.
Figure 3C:
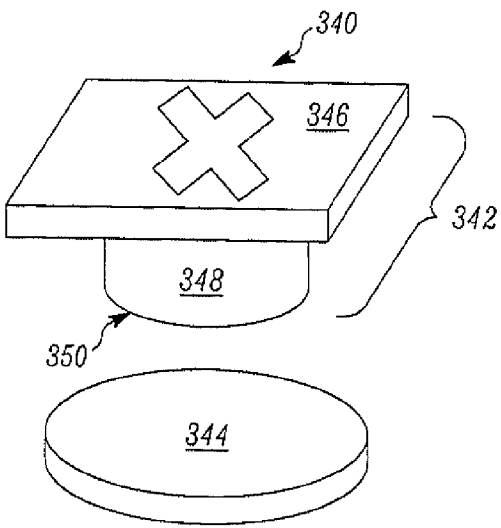
FIG. 3C illustrates a two-piece actuator and flange that can be used with the keypad of FIG. 1.
Figure 3A:
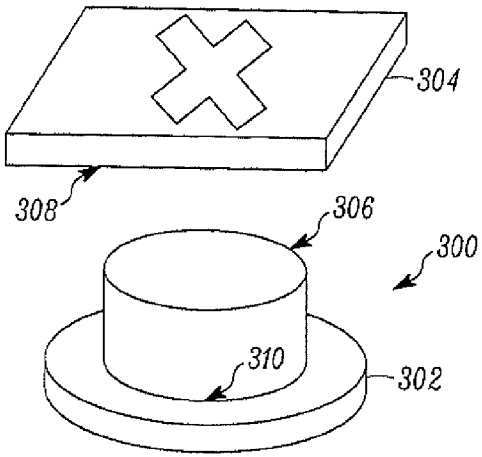
FIG. 3A illustrates an actuator formed with a flange that can be used with the keypad of FIG. 1.

FIG. 3A illustrates an actuator 300 that can be used with the keypad 100 of FIG. 1. In one embodiment, a flange 302 is integrated with the actuator 300. Thus, the actuator 300 is inserted through an aperture in the frame 112 (FIG. 1) prior to a keycap 304 being mechanically attached to the actuator 300.

The actuator 300 includes a first end 306 that is rigidly attached to the underside 308 of the keycap 304. For example, the actuator 300 can be glued to the keycap 304. Alternatively, the actuator 300 can be fastened to the keycap 300 using screws or other fasteners. In one embodiment, the actuator 300 is welded to the keycap 304. The actuator 300 and the keycap 304 can be fabricated from plastic, metal, ceramic, or any other suitably rigid material. The actuator 300 can be any suitable shape, such as cylindrical. For example, a cross-sectional shape of the actuator 300 can be substantially circular, rectangular, square, oval, or cross-shaped. The flange 302 can also be any suitable shape.

A second end 310 of the actuator 300 includes the flange 302. The actuator 300 can be fabricated with the flange 302, such that the actuator 300 and the flange 302 embody a single, integrated piece. Alternatively, the flange 302 can be a separate part that is rigidly mounted to the second end 310 of the actuator 300. For example, the flange 302 can be mounted to the actuator 300 with glue. Alternatively, the flange 302 can be mounted to the actuator 300 using screws or other fasteners. In one embodiment, the flange 302 is welded to the actuator 300. The flange 302 can be fabricated from plastic, metal, ceramic, or any other suitably rigid material.

In one embodiment, the flange 302 is contiguous around the second end 310 of the actuator 300. In another embodiment, a plurality of flanges can be included on the second end 310 of the actuator 300.

FIG. 3B illustrates an actuator 320 that can be used with the keypad 100 of FIG. 1. The actuator 320 includes a first end 322 that is rigidly attached to the underside of a keycap (not shown). For example, the actuator 320 can be glued to the keycap. Alternatively, the actuator 320 can be fastened to the keycap using screws or other fasteners. In one embodiment, the actuator 320 is welded to the keycap. The actuator 320 can be fabricated from plastic, metal, ceramic, or any other suitably rigid material.

A second end 324 of the actuator 320 includes a plurality of flanges 326, 328. The actuator 320 can be fabricated with the flanges 326, 328, such that the actuator 320 and the flanges 326, 328 embody a single, integrated piece. Alternatively, each flange 326, 328 can be a separate part that is rigidly mounted to the second end 324 of the actuator 320. For example, the flanges 326, 328 can be mounted to the actuator 320 with glue. Alternatively, the flanges 326, 328 can be mounted to the actuator 320 using screws or other fasteners. In one embodiment, each flange 326, 328 is welded to the second end 324 of the actuator 320. The flanges 326, 328 can be fabricated from plastic, metal, ceramic, or any other suitably rigid material. The flanges 326, 328 can be any suitable shape. Skilled artisans will appreciate that any number of flanges can be used.

FIG. 3C illustrates a two-piece embodiment 340 including an actuator 342 and a flange 344 that can be used with the keypad of FIG. 1. The actuator 342 includes a keycap 346 with an integrated post 348. In one embodiment, the keycap 346/post 348 is fabricated from a single piece of material. The flange 344 is mechanically coupled to an end 350 of the keycap 346/post 348. For example, the flange 344 can be glued to the end 350. Alternatively, the flange 344 can be attached to the end 350 using a fastener, such as a screw. In one embodiment, the flange 344 is welded to the end 350. In practice, the flange 344 can be attached to the end 350 using any suitable technique.

The exemplary embodiments provide for a tamper-resistant keypad device for a mobile device that is bezel-less and includes pick-resistant keycaps.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While at least one example embodiment has been presented in the foregoing detailed description, it should be appreciated that a vast number of variations exist. It should also be appreciated that the example embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

In addition, the section headings included herein are intended to facilitate a review but are not intended to limit the scope of the present invention. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

What is claimed is:

1. A keypad comprising:

a keycap for actuation by a user;

an actuator having a first end and a second end, the first end being coupled to the keycap, the second end comprising a flange; and a frame positioned between an underside of the keycap and the flange, the frame having an aperture adapted to receive the actuator such that the second end of the actuator is captured by the frame, thereby preventing the actuator from being removed from the frame.

2. The keypad of claim 1 wherein the first end of actuator is integrally formed with the keycap such that the actuator and the keycap embody a single part.

3. The keypad of claim 1 wherein the flange is coupled to the second end of the actuator.

4. The keypad of claim 1 wherein the flange is integrally formed with the actuator such that the flange and the actuator embody a single part.

5. The keypad of claim 1, wherein a cross-sectional shape of the actuator is one of substantially circular, rectangular, square, oval, and cross-shaped.

6. The keypad of claim 1, wherein the aperture is sized so as to prevent the flange from passing through the aperture.

7. The keypad of claim 1, wherein the first end of the actuator is coupled to the keycap by fastening the actuator to the keycap.

8. The keypad of claim 1 further comprising a printed circuit board positioned adjacent to the frame such that the second end of the actuator is capable of activating a switch on the printed circuit board upon actuation of the keycap by the user.

9. The keypad of claim 8 further comprising a contact dome coupled to the printed circuit board, the second end of the actuator being capable of compressing the contact dome upon actuation of the keycap by the user.

10. A keypad comprising:

a plurality of keycaps for actuation by a user;

a plurality of actuators, each having a first end and a second end, the first end of each actuator being coupled to a corresponding keycap of the plurality of keycaps, the second end of each actuator comprising a flange; and a frame, positioned between an underside of each of the plurality of keycaps and a corresponding flange, the frame having a plurality of apertures each adapted to receive one of the plurality of actuators such that the second end of each actuator is captured by the frame, thereby preventing each actuator from being removed from the frame.

11. The keypad of claim 10 wherein the flange is coupled to the second end of each actuator.

12. The keypad of claim 10 wherein the flange is integrally formed with each actuator such that the flange and the actuator embody a single part.

13. The keypad of claim 10, wherein each of the plurality of apertures is sized so as to prevent a corresponding flange from passing through it.

14. The keypad of claim 10, wherein the first end of each actuator is coupled to a corresponding keycap of the plurality of keycaps by fastening the actuator to the corresponding keycap.

15. The keypad of claim 10 further comprising a printed circuit board positioned adjacent to the frame such that the second end of each actuator is capable of activating a switch on the printed circuit board upon actuation of each corresponding keycap by the user.

16. The keypad of claim 15 further comprising a plurality of contact domes coupled to the printed circuit board, the second end of each actuator being capable of compressing each contact dome upon actuation of each corresponding keycap by the user.

17. A method of manufacturing a keypad comprising:

inserting an actuator having a first end and a second end into an aperture of a frame, the second end of the actuator comprising a flange, the frame positioned between an underside of the keycap and the flange, such that the second end of the actuator is captured by the frame, thereby preventing the actuator from being removed from the frame;

attaching a keycap to the first end of the actuator; and positioning the frame adjacent to a printed circuit board such that the second end of the actuator is capable of contacting a contact dome on the printed circuit board upon actuation of the keycap by a user.

18. The method of claim 17 further comprising forming a flange on the second end of the actuator.

19. The method of claim 17 further comprising attaching a flange to the second end of the actuator.

20. The method of claim 17, wherein the aperture is sized so as to prevent the flange from passing through it.

* * * * *